US010578109B2

(12) United States Patent
Daussin et al.

(10) Patent No.: US 10,578,109 B2
(45) Date of Patent: Mar. 3, 2020

(54) SCROLL COMPRESSOR HAVING AN OIL DISCHARGE DEVICE

(71) Applicant: Danfoss Commercial Compressors, Trevoux (FR)

(72) Inventors: Arnaud Daussin, Saint German au Mont d'or (FR); Patrice Bonnefoi, Saint Didier au Mont d'or (FR); Yves Rosson, Villars les Dombes (FR); Ingrid Claudin, Villars les Dombes (FR)

(73) Assignee: Danfoss Commercial Compressors, Trevoux (FR)

( * ) Notice: Subject to any disclaimer, the term of this patent is extended or adjusted under 35 U.S.C. 154(b) by 298 days.

(21) Appl. No.: 15/542,487

(22) PCT Filed: Oct. 16, 2015

(86) PCT No.: PCT/EP2015/074012
§ 371 (c)(1),
(2) Date: Jul. 10, 2017

(87) PCT Pub. No.: WO2016/113006
PCT Pub. Date: Jul. 21, 2016

(65) Prior Publication Data

US 2018/0274543 A1 Sep. 27, 2018

(30) Foreign Application Priority Data

Jan. 13, 2015 (FR) ..... 15 50262

(51) Int. Cl.
*F04C 29/02* (2006.01)
*F04C 23/00* (2006.01)
*F04C 18/02* (2006.01)

(52) U.S. Cl.
CPC ..... *F04C 29/02* (2013.01); *F04C 18/0223* (2013.01); *F04C 23/008* (2013.01)

(58) Field of Classification Search
CPC ..... F04C 18/0223; F04C 29/02
See application file for complete search history.

(56) References Cited

U.S. PATENT DOCUMENTS

2010/0080722 A1 4/2010 Muroi et al.
2011/0070114 A1 3/2011 Milliff
(Continued)

FOREIGN PATENT DOCUMENTS

CN 1938519 A 3/2007
DE 102007043674 A1 3/2009
(Continued)

OTHER PUBLICATIONS

International Search Report from corresponding PCT application, PCT/EP2015/074012.

*Primary Examiner* — Mary Davis
(74) *Attorney, Agent, or Firm* — Carlson, Gaskey & Olds, P.C.

(57) ABSTRACT

A scroll compressor including a compression unit includes a first non-orbiting scroll having a receiving cavity and an orbiting scroll arrangement. The compression unit further includes a refrigerant suction part suitable for supplying the compression unit with a refrigerant flow, and a first anti-rotation device located in the receiving cavity and configured to prevent rotation of the orbiting scroll arrangement with respect to the first fixed non-orbiting scroll. The compression unit further includes an oil discharge device including an oil discharge passage, the oil discharge passage includes an oil inlet fluidly connected to the receiving cavity
(Continued)

and at least one oil discharge outlet located in a refrigerant flow path and configured to supply the refrigerant flow with oil from the receiving cavity.

15 Claims, 6 Drawing Sheets

(56) References Cited

U.S. PATENT DOCUMENTS

| | | | | |
|---|---|---|---|---|
| 2017/0241420 | A1* | 8/2017 | Nouyrigat | F04C 18/0223 |
| 2017/0363085 | A1* | 12/2017 | Nilangekar | F04C 29/02 |

FOREIGN PATENT DOCUMENTS

| | | | |
|---|---|---|---|
| EP | 529660 | | 3/1993 |
| EP | 1464840 | | 10/2004 |
| JP | H01301972 | A | 12/1989 |
| JP | H05321856 | A | 12/1993 |
| JP | H06330867 | A | 11/1994 |
| WO | 2014191282 | | 12/2014 |

* cited by examiner

SCROLL COMPRESSOR HAVING AN OIL DISCHARGE DEVICE

CROSS-REFERENCE TO RELATED APPLICATIONS

This application is the U.S. national phase of PCT/EP2015/074012, filed 16 Oct. 2015, which claims priority to FR 1550262, filed 13 Jan. 2015.

FIELD OF THE INVENTION

The present invention relates to a scroll compressor, and in particular to a scroll refrigeration compressor.

BACKGROUND

Scroll compressors are known and typically include a closed container. A compression unit is disposed in the closed container, including at least a first fixed scroll including a first fixed base plate and a first fixed spiral wrap, the first fixed base plate including a receiving cavity, and an orbiting scroll arrangement including a first orbiting spiral wrap. The first fixed spiral wrap and the first orbiting spiral wrap fit together, forming a plurality of compression chambers.

Scroll compressors typically further include at least one Oldham coupling located in the receiving cavity and configured to prevent rotation of the orbiting scroll arrangement with respect to the first fixed scroll. The Oldham coupling includes a pair of engaging elements configured to slidably engage with a pair of complementary engaging elements provided on the first fixed scroll.

Scroll compressors typically further include a drive shaft adapted to drive the orbiting scroll arrangement in an orbital movement, and a refrigerant suction part for supplying the compression unit with a refrigerant flow to be compressed.

The location of the Oldham coupling within the receiving cavity may lead to an improper lubrication of the Oldham coupling, and particularly its engaging elements. Due to its location, the Oldham coupling cannot be optimally lubricated by the oil droplets contained in the refrigerant flow.

Therefore, in order to optimize the Oldham coupling's lubrication, a scroll compressor may further include a dedicated oil lubrication system configured to at least partially lubricate the Oldham coupling.

Regardless of the configuration of the scroll compressor, at least a part of the lubrication oil is collected in the receiving cavity. Over time this may lead to an increase in friction between the Oldham coupling and the lubrication oil due to too large of an accumulation of lubrication oil in the receiving cavity. Accordingly, such an oil accumulation in the receiving cavity may harm the efficiency of the compression unit, and therefore the efficiency of the scroll compressor.

SUMMARY

In a featured embodiment, a compression unit includes a first non-orbiting scroll comprising a first non-orbiting base plate and a first non-orbiting spiral wrap, the first non-orbiting base plate including a receiving cavity. The compression unit further includes an orbiting scroll arrangement including a first orbiting spiral wrap, and the first non-orbiting spiral wrap and the first orbiting spiral wrap fit together, forming a plurality of first compression chambers. The compression unit further includes a refrigerant suction part operable to supply the compression unit with a refrigerant flow, and a first anti-rotation device located in the receiving cavity and configured to prevent rotation of the orbiting scroll arrangement with respect to the first non-orbiting scroll. The compression unit further includes an oil discharge device including an oil discharge passage. The oil discharge passage includes an oil inlet in fluid communication with the receiving cavity and at least one oil discharge outlet located in a refrigerant flow path upstream of the first compression chambers with respect to a refrigerant flow direction. The at least one oil discharge outlet is configured to supply the refrigerant flow with oil from the receiving cavity.

In another embodiment according to the previous embodiments, the receiving cavity includes an oil collecting portion configured to collect at least a part of the oil contained in the receiving cavity. The oil inlet is in fluid communication with the oil collecting portion. Advantageously, the oil inlet emerges in the oil collecting portion.

In another embodiment according to the previous embodiments, the oil collecting portion is located at the deepest point of the receiving cavity.

In another embodiment according to the previous embodiments, the oil discharge device includes a mounting part mounted on the first non-orbiting base plate.

In another embodiment according to the previous embodiments, the oil discharge device includes a discharge part provided with the at least one oil discharge outlet, the discharge part being located within the refrigerant suction part.

In another embodiment according to the previous embodiments, the oil discharge device includes a connecting part extending through a notch provided on the refrigerant suction part. The notch may, in one example, be provided on an end portion of the refrigerant suction part and oriented towards the first compression chambers.

In another embodiment according to the previous embodiments, the mounting part and the discharge part are connected by the connecting part.

In another embodiment according to the previous embodiments, the notch provided on the refrigerant suction part is configured to receive a portion of an orbiting base plate of the orbiting scroll arrangement during at least a part of the orbital movement of the orbiting scroll arrangement.

In another embodiment according to the previous embodiments, the refrigerant suction part is formed by a refrigerant suction element connected and sealed to the compression unit.

In another embodiment according to the previous embodiments, the compression unit further includes a second non-orbiting scroll including a second non-orbiting base plate and a second non-orbiting spiral wrap. The first and second non-orbiting scrolls define an inner volume, and the orbiting scroll arrangement is disposed within the inner volume and further includes a second orbiting spiral wrap. The second non-orbiting spiral wrap fits together with the second orbiting spiral wrap, forming a plurality of second compression chambers.

In another embodiment according to the previous embodiments, the first non-orbiting scroll further includes a first non-orbiting guiding portion extending from an outer end portion of the first non-orbiting spiral wrap. The first non-orbiting guiding portion partially delimits a first refrigerant inlet passage, and the refrigerant suction part is configured to conduct at least a part of the refrigerant flow towards the first refrigerant inlet passage.

In another embodiment according to the previous embodiments, the second non-orbiting scroll further includes a second non-orbiting guiding portion extending from an outer end portion of the second non-orbiting spiral wrap. The second non-orbiting guiding portion partially delimits a second refrigerant inlet passage, and the refrigerant suction part is configured to conduct at least a part of the refrigerant flow towards the second refrigerant inlet passage.

In another embodiment according to the previous embodiments, the first non-orbiting spiral wrap defines a first spiral path fluidly connected to the first refrigerant inlet passage.

In another embodiment according to the previous embodiments, the second non-orbiting spiral wrap defines a second spiral path fluidly connected to the second refrigerant inlet passage.

In another embodiment according to the previous embodiments, the width of the first refrigerant inlet passage decreases in the refrigerant flow direction.

In another embodiment according to the previous embodiments, the width of the second refrigerant inlet passage decreases in the refrigerant flow direction.

In another embodiment according to the previous embodiments, the refrigerant supplying aperture has an upper section facing and emerging in the first refrigerant inlet passage and a lower section facing and emerging in the second refrigerant inlet passage.

In another embodiment according to the previous embodiments, the first refrigerant inlet passage is delimited by the first non-orbiting guiding portion, the first non-orbiting base plate, and the orbiting base plate of the orbiting scroll arrangement.

In another embodiment according to the previous embodiments, the second refrigerant inlet passage is delimited by the second non-orbiting guiding portion, the second non-orbiting base plate, and the orbiting base plate of the orbiting scroll arrangement.

In another embodiment according to the previous embodiments, the first and second refrigerant inlet passages are located one above the other.

In another embodiment according to the previous embodiments, the scroll compressor further includes a refrigerant deflector configured to deflect a first part of the refrigerant flow towards the first compression chambers, and a second part of the refrigerant flow towards the second compression chambers.

In another embodiment according to the previous embodiments, the refrigerant deflector is configured to deflect the first part of the refrigerant flow towards the first refrigerant inlet passage, and the second part of the refrigerant flow towards the second refrigerant inlet passage.

In another embodiment according to the previous embodiments, the at least one oil discharge outlet is located downstream of a nose portion of the refrigerant deflector with respect to the refrigerant flow direction.

In another embodiment according to the previous embodiments, the oil discharge passage includes at least a first oil discharge outlet located upstream the first compression chambers with respect to the refrigerant flow direction, and configured to supply the first part of the refrigerant flow with oil from the receiving cavity, and a second oil discharge outlet located upstream the second compression chambers with respect to the refrigerant flow direction, and configured to supply the second part of the refrigerant flow with oil from the receiving cavity.

In another embodiment according to the previous embodiments, the refrigerant deflector includes a first deflecting surface configured to deflect the first part of the refrigerant flow towards the first compression chambers and a second deflecting surface configured to deflect the second part of the refrigerant flow towards the second compression chambers. The oil discharge device is configured such that the first oil discharge outlet is offset outwardly with respect to the first deflecting surface and the second oil discharge outlet is offset outwardly with respect to the second deflecting surface.

In another embodiment according to the previous embodiments, the refrigerant deflector is integral with the oil discharge device. Advantageously, the refrigerant deflector and oil discharge device are one piece.

In another embodiment according to the previous embodiments, the first and second oil discharge outlets project from the first and second deflecting surfaces respectively.

In another embodiment according to the previous embodiments, the refrigerant deflector is located within the refrigerant suction part.

In another embodiment according to the previous embodiments, the first anti-rotation device includes at least a first pair of engaging elements configured to slidably engage with a pair of complementary engaging elements provided on the first non-orbiting base plate. The complementary engaging elements divide a bottom portion of the receiving cavity into two bottom parts, and the first non-orbiting base plate further includes a communication passage fluidly connecting the two bottom parts of the receiving cavity.

In another embodiment according to the previous embodiments, the communication passage is in fluid communication with the oil collecting portion.

In another embodiment according to the previous embodiments, the first anti-rotation device is an Oldham coupling.

In another embodiment according to the previous embodiments, the scroll compressor further includes a second anti-rotation device configured to prevent rotation of the orbiting scroll arrangement with respect to the second non-orbiting scroll. The second anti-rotation device may, in one example, be an Oldham coupling.

In another embodiment according to the previous embodiments, the first and second anti-rotation devices are located in the inner volume.

In another embodiment according to the previous embodiments, the receiving cavity is substantially annular.

In another embodiment according to the previous embodiments, the first non-orbiting scroll is disposed below the second non-orbiting scroll.

In another embodiment according to the previous embodiments, the receiving cavity is open in an upward direction.

In another embodiment according to the previous embodiments, the receiving cavity is provided on a face of the first non-orbiting base plate, and is oriented towards the orbiting scroll arrangement.

These and other features may be best understood from the following drawings and specifications.

DETAILED DESCRIPTION

Figure 1:
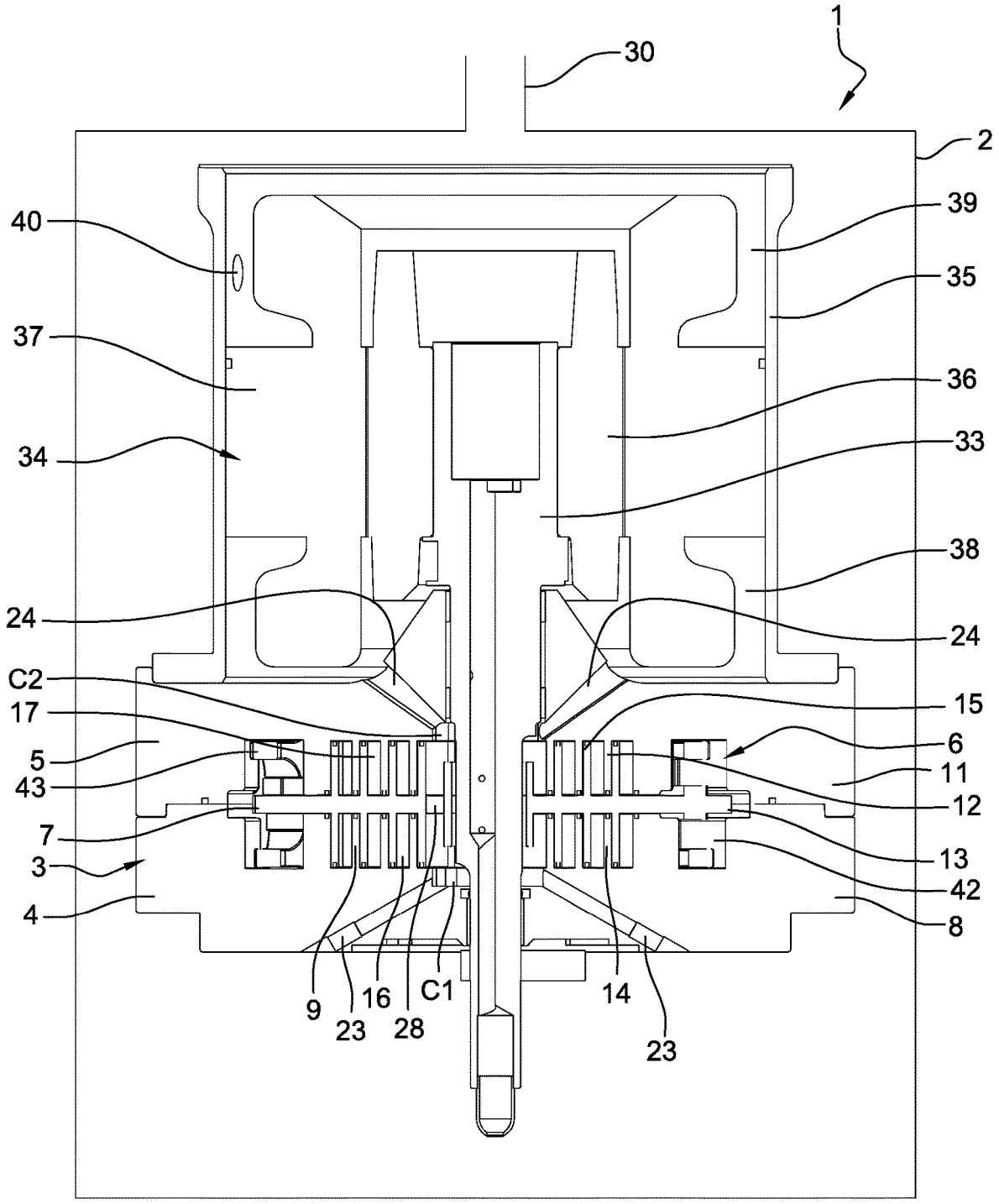
FIG. 1 is a longitudinal section view of a scroll compressor according to the invention.
Figure 2:
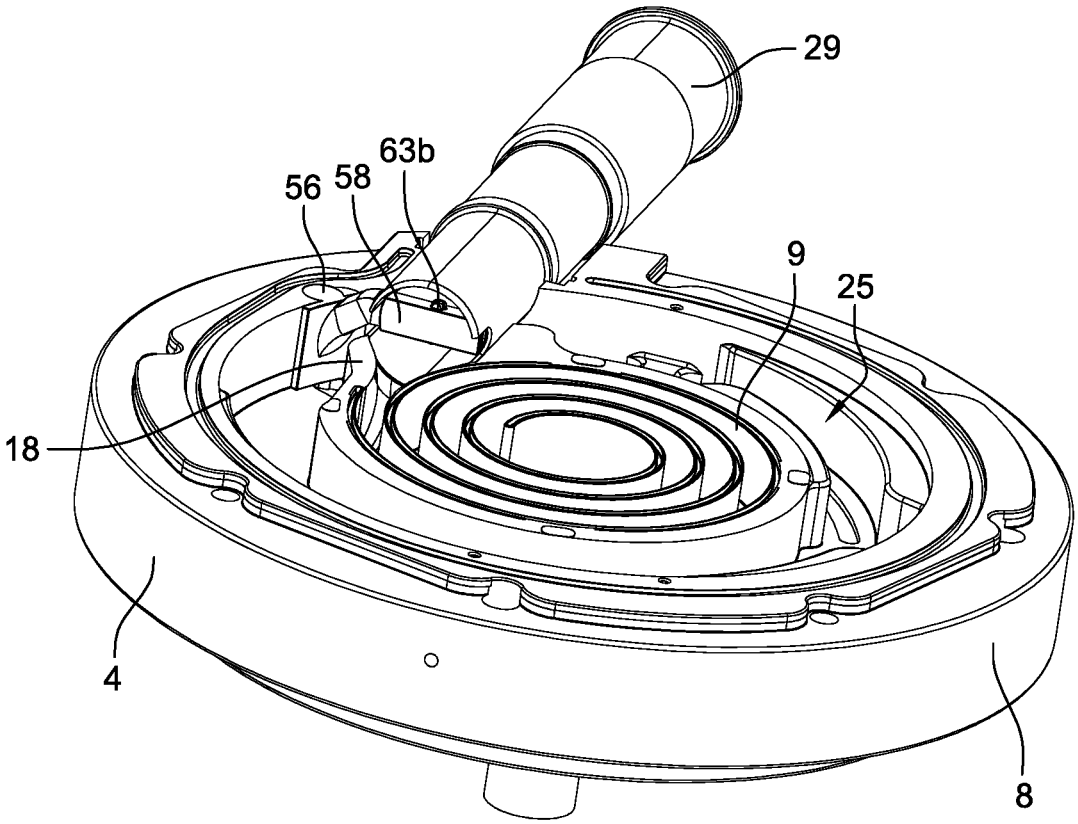
FIG. 2 is perspective view of a lower fixed scroll, an oil discharge device and a refrigerant suction pipe of the scroll compressor of FIG. 1.
Figure 3:
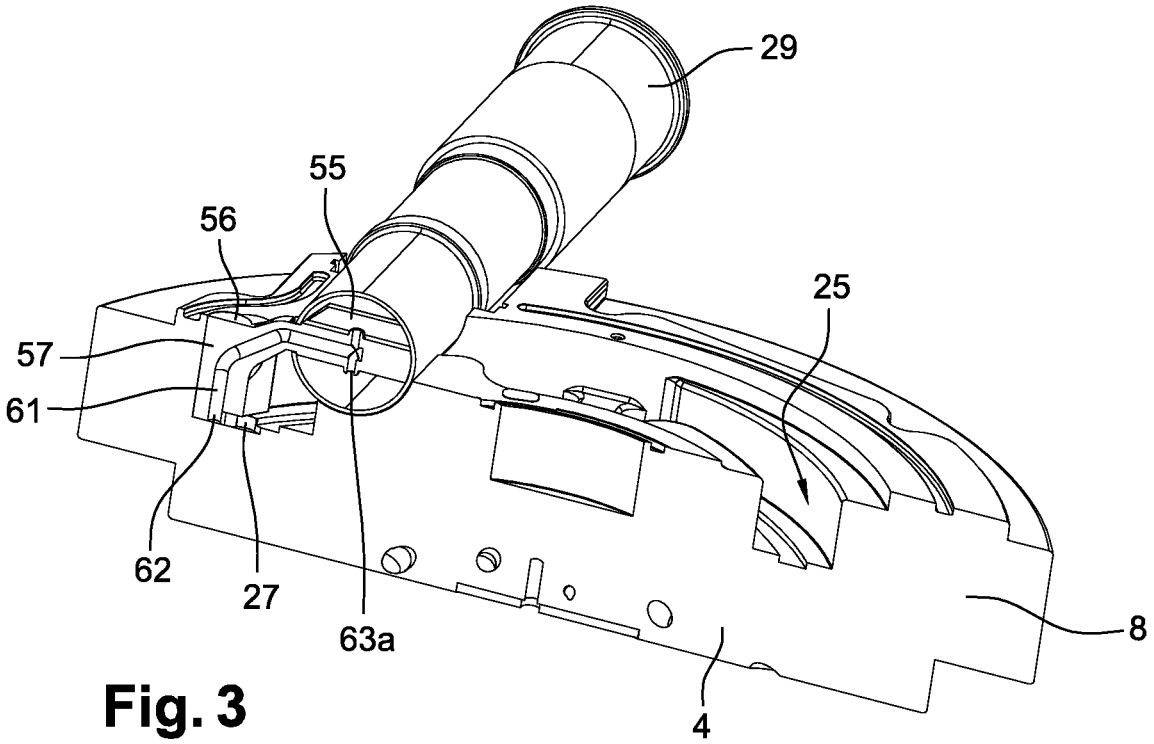
FIG. 3 is a longitudinal section view, in perspective, of the lower fixed scroll, the oil discharge device and the refrigerant suction pipe of FIG. 2.

FIG. 1 shows a vertical scroll compressor 1 including a closed container 2 defining a high pressure discharge volume, and a compression unit 3 disposed inside the closed container 2.

The compression unit 3 includes lower and upper fixed, or non-orbiting, scrolls 4, 5 defining an annular inner volume 6, and an orbiting scroll arrangement 7 disposed in the inner volume 6. The lower and upper fixed scrolls 4, 5 are located below and above the orbiting scroll arrangement 7 respectively. The upper fixed scroll 5 may, in one example, be secured to the lower fixed scroll 4.

Figure 10:
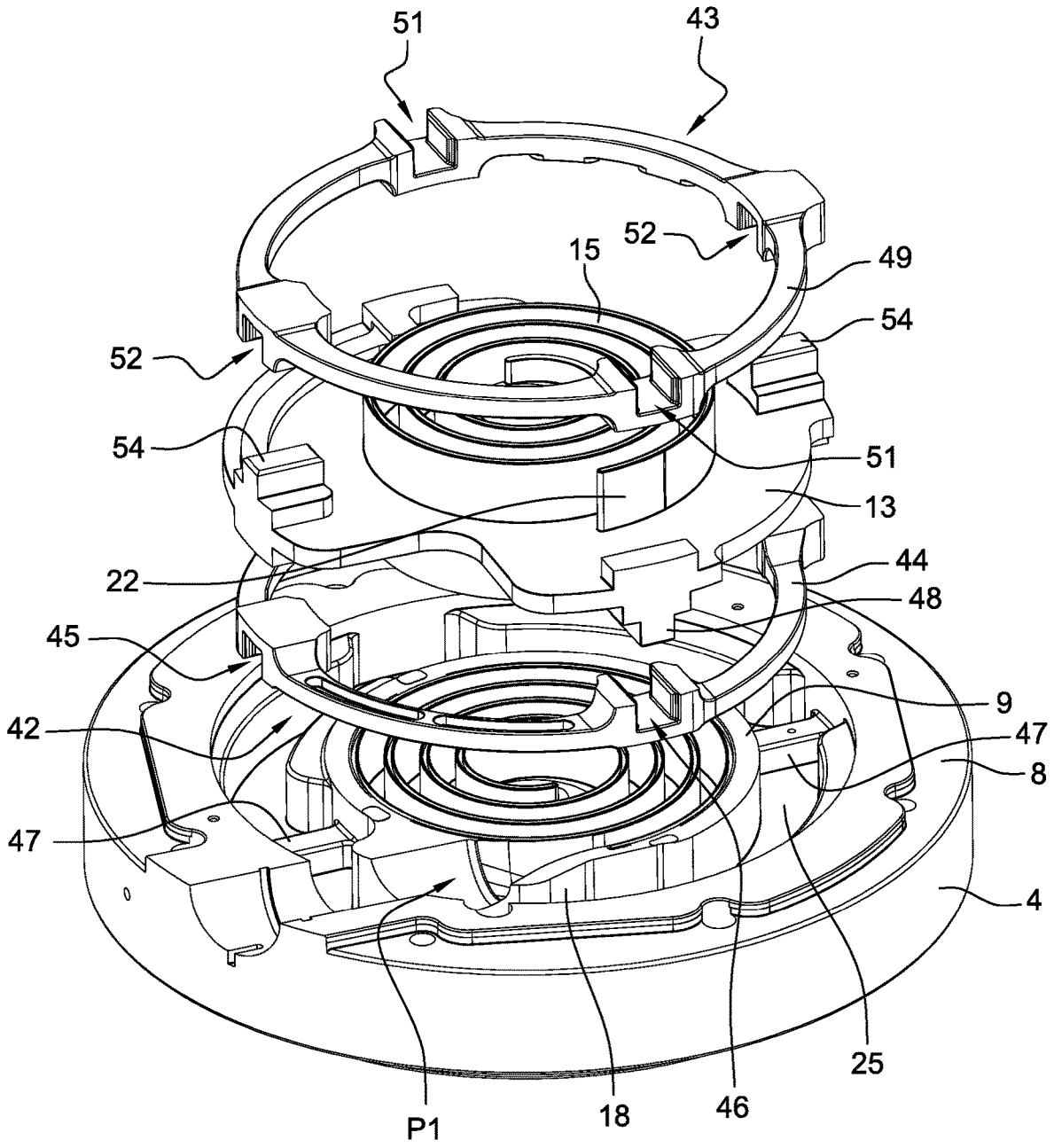
FIGS. 10 and 11 are exploded perspective views of two Oldham couplings and of an orbiting scroll arrangement of the scroll compressor of FIG. 1.
Figure 11:
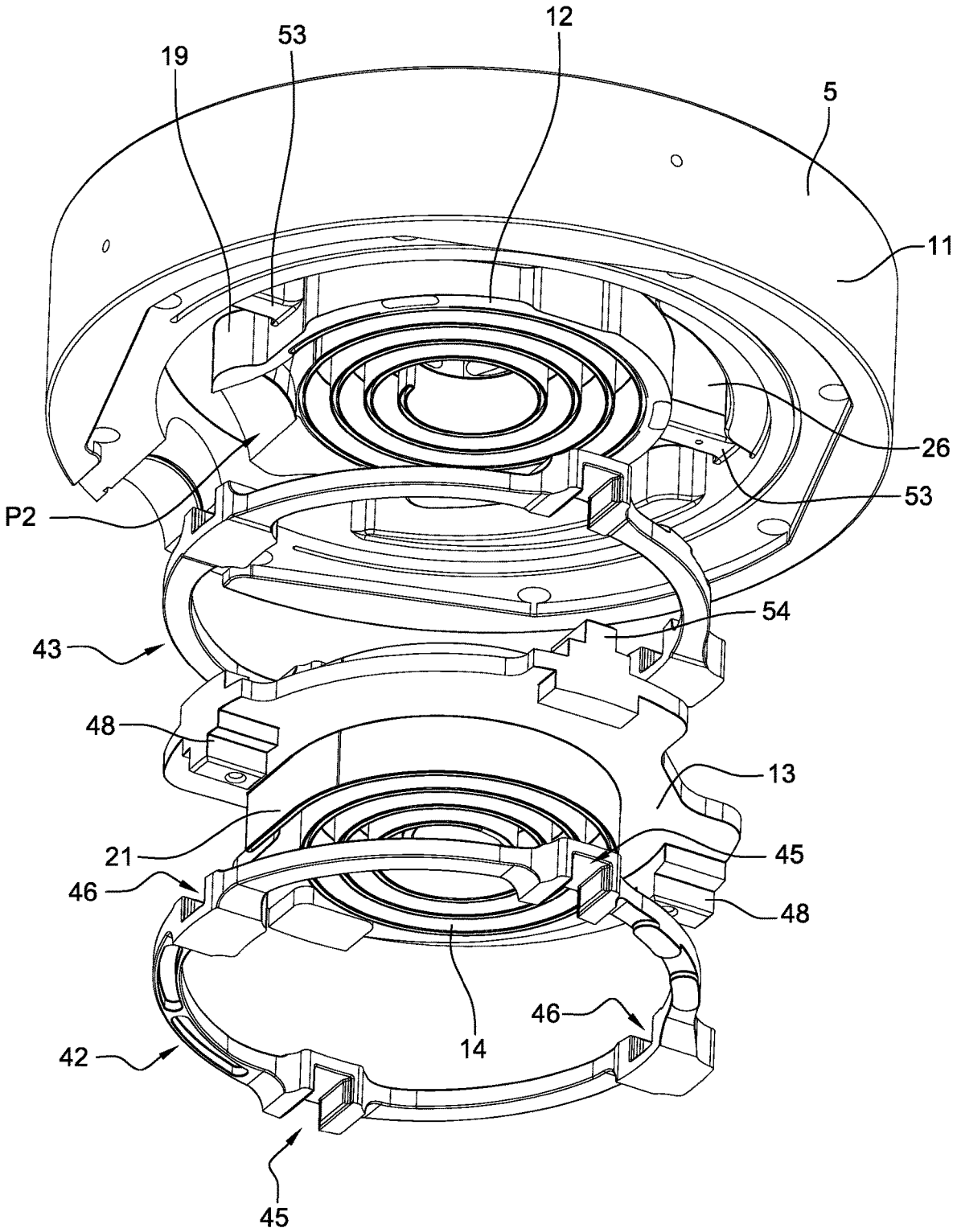

As shown in FIGS. 1, 10 and 11, the lower fixed scroll 4 includes a base plate 8 and a spiral wrap 9 projecting from the base plate 8 towards the upper fixed scroll 5, and the upper fixed scroll 5 includes a base plate 11 and a spiral wrap 12 projecting from the base plate 11 towards the lower fixed scroll 4.

The orbiting scroll arrangement 7 includes a base plate 13, a spiral wrap 14 projecting from a first face of the base plate 13 towards the lower fixed scroll 4, and a spiral wrap 15 projecting from a second face of the base plate 13 towards the upper fixed scroll 5. The second face is opposite to the first face such that the spiral wraps 14, 15 project in opposite directions.

As shown in FIG. 1, the spiral wrap 14 of the orbiting scroll arrangement 7 meshes with the spiral wrap 9 of the lower fixed scroll 4 to form a plurality of compression chambers 16 between them, and the spiral wrap 15 of the orbiting scroll arrangement 7 meshes with the spiral wrap 12 of the upper fixed scroll 5 to form a plurality of compression chambers 17 between them. Each of the compression chambers 16, 17 has a variable volume which decreases from the outside towards the inside, when the orbiting scroll arrangement 7 is driven to orbit relative to the lower and upper fixed scrolls 4, 5.

Figure 5:
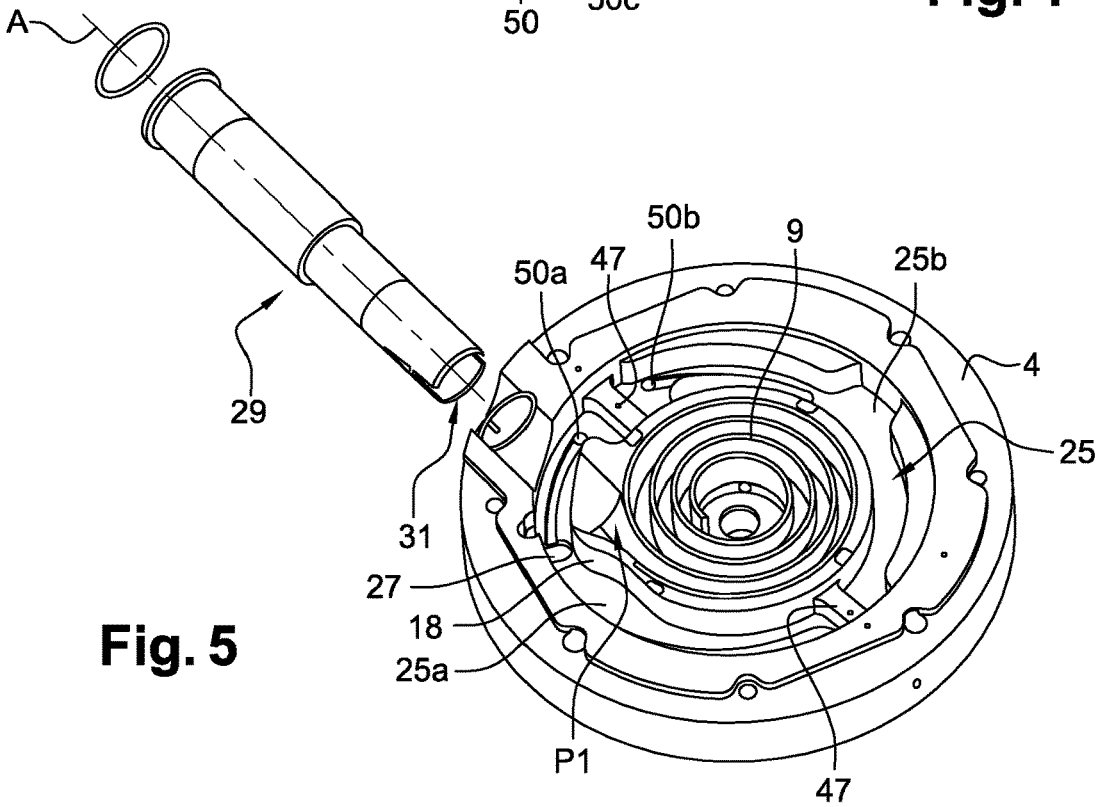
FIG. 5 is an exploded perspective view of a lower fixed scroll and of a refrigerant suction pipe of the scroll compressor of FIG. 1.

As shown on FIGS. 5, 10 and 11, the lower fixed scroll 4 further includes a fixed guiding portion 18 extending from the outer end portion of the spiral wrap 9, and the upper fixed scroll 5 further includes a fixed guiding portion 19 extending from the outer end portion of the spiral wrap 12.

The base plate 8, the spiral wrap 9, the fixed guiding portion 18 and the base plate 13 delimit a first refrigerant inlet passage P1. The spiral wrap 12, the fixed guiding portion 19 and the base plate 13 delimit a second refrigerant inlet passage P2.

As shown in FIGS. 10 and 11 the orbiting scroll arrangement 7 further includes an orbiting guiding portion 21 projecting from the first face of the base plate 13 and extending tangentially from the outer end portion of the spiral wrap 14, and an orbiting guiding portion 22 projecting from the second face of the base plate 13 and extending tangentially from the outer end portion of the spiral wrap 15.

The orbiting guiding portion 21 extends in the first refrigerant inlet passage P1 and is configured to guide the refrigerant supplied to the first refrigerant inlet passage P1 towards the compression chambers 16, and more particularly towards the two outermost compression chambers 16. The orbiting guiding portion 22 extends in the second refrigerant inlet passage P2 and is configured to guide the refrigerant supplied to the second refrigerant inlet passage P2 towards the compression chambers 17, and more particularly towards the two outermost compression chambers 17.

Returning to FIG. 1, the lower fixed scroll 4 includes a plurality of discharge passages 23 in fluid communication with the high pressure discharge volume and arranged to conduct the refrigerant compressed in the compression chambers 16 outside the inner volume 6. Each discharge passage 23 includes an inlet aperture emerging in an annular chamber C1 in fluid communication with the central compression chamber 16 and provided on a first face of the base plate 8 oriented towards the base plate 11 of the upper fixed scroll 5. Each discharge passage 23 further includes an outlet aperture emerging in a second face of the base plate 8 opposite to the first face of the base plate 8.

The upper fixed scroll 5 also includes a plurality of discharge passages 24 in fluid communication with the high pressure discharge volume and arranged to conduct the refrigerant compressed in the compression chambers 17 outside the inner volume 6. Each discharge passage 24 includes an inlet aperture emerging in an annular chamber C2 in fluid communication with the central compression chamber 17 and provided on a first face of the base plate 11 of the upper fixed scroll 5 oriented towards the base plate 8 of the lower fixed scroll 4. Each discharge passage 24 further includes an outlet aperture emerging in a second face of the base plate 11 opposite to the first face of the base plate 11.

As best shown in FIGS. 10 and 11, the lower fixed scroll 4 further includes a receiving cavity 25 substantially annular and provided on the first face of the base plate 8, and the upper fixed scroll 5 further includes a receiving cavity 26 substantially annular and provided on the first face of the base plate 11. As better shown in FIG. 5, the receiving cavity 25 includes an oil collecting portion 27 configured to collect at least a part of the oil contained in the receiving cavity 25. Advantageously, the oil collecting portion 27 is located at the deepest point of the receiving cavity 25.

Returning to FIG. 1, the orbiting scroll arrangement 7 further includes at least one communicating hole 28 configured to fluidly connect the central compression chamber 16 and the central compression chamber 17. The communicating hole 28 may, in one example, emerge in both the central compression chambers 16, 17.

Figure 6:
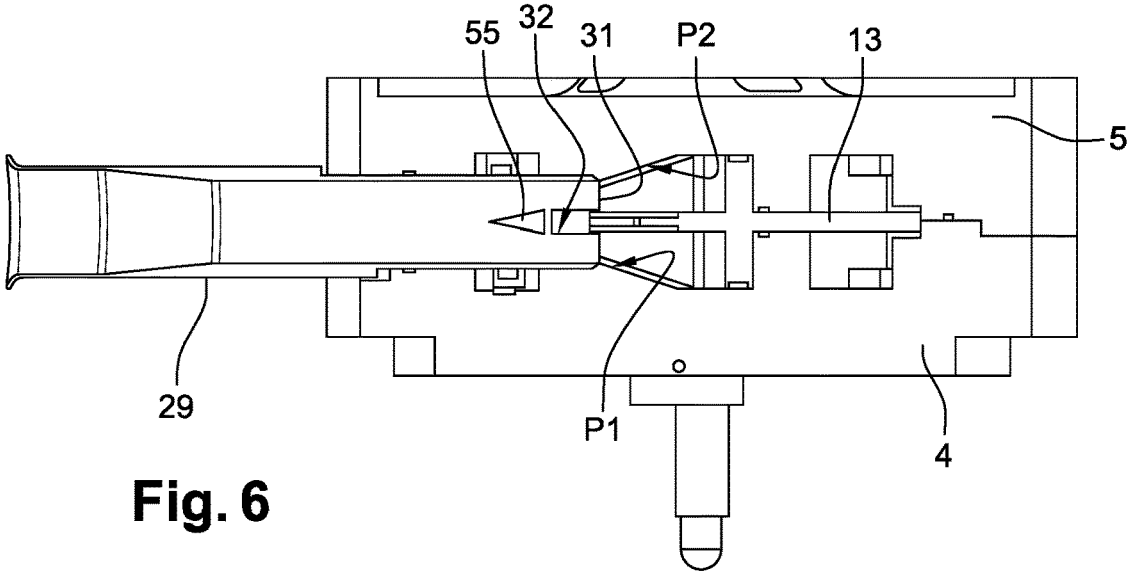
FIG. 6 is partial longitudinal section views of the scroll compressor of FIG. 1.
Figure 7:
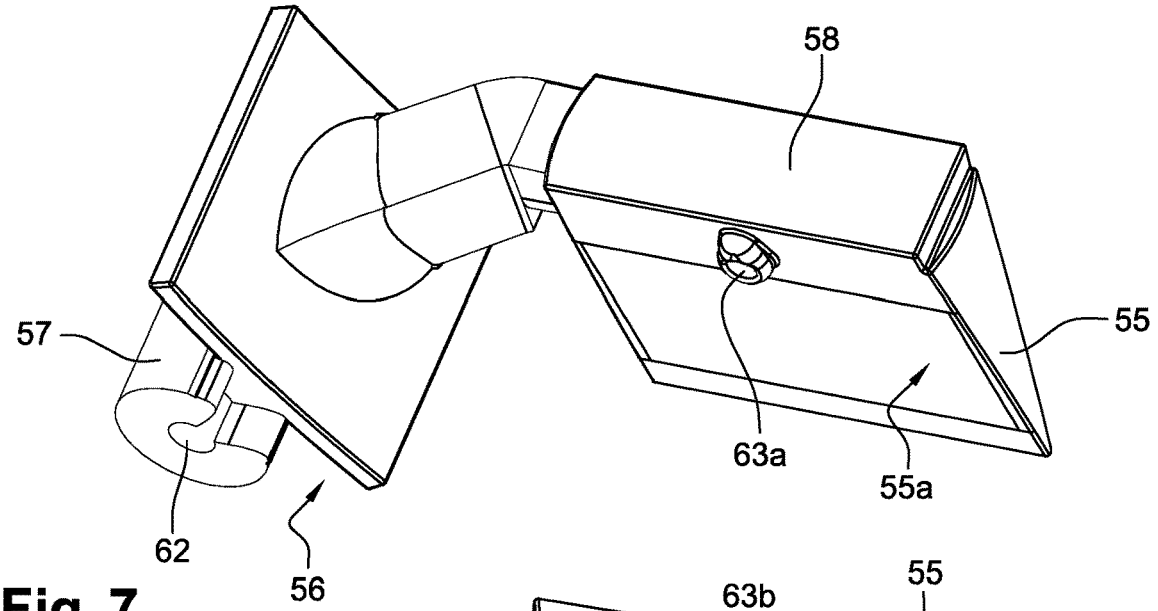
FIGS. 7 and 8 are perspective views of the oil discharge device.
Figure 8:
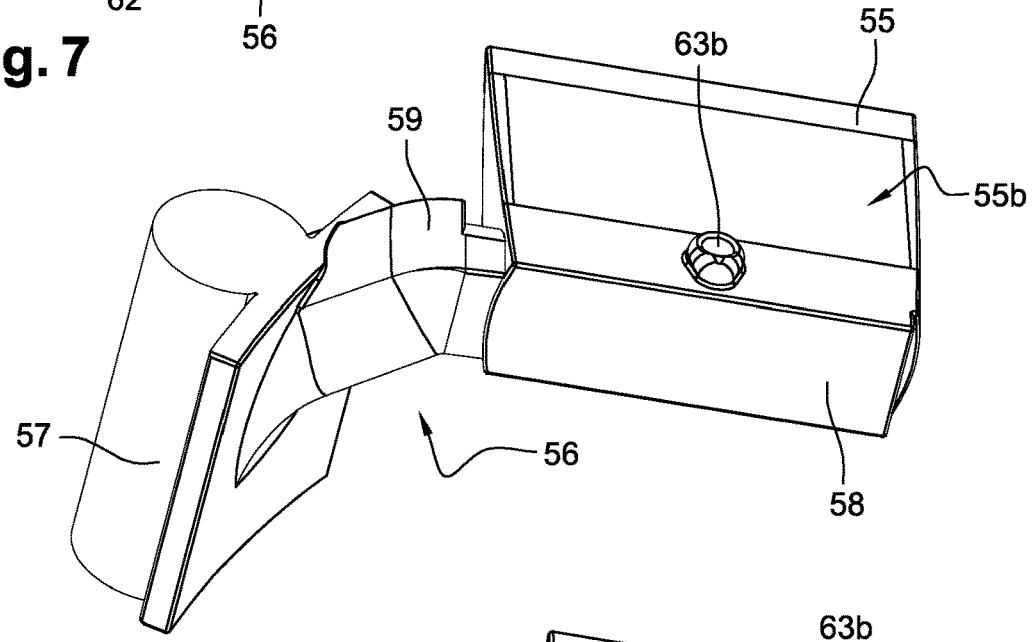
Figure 9:
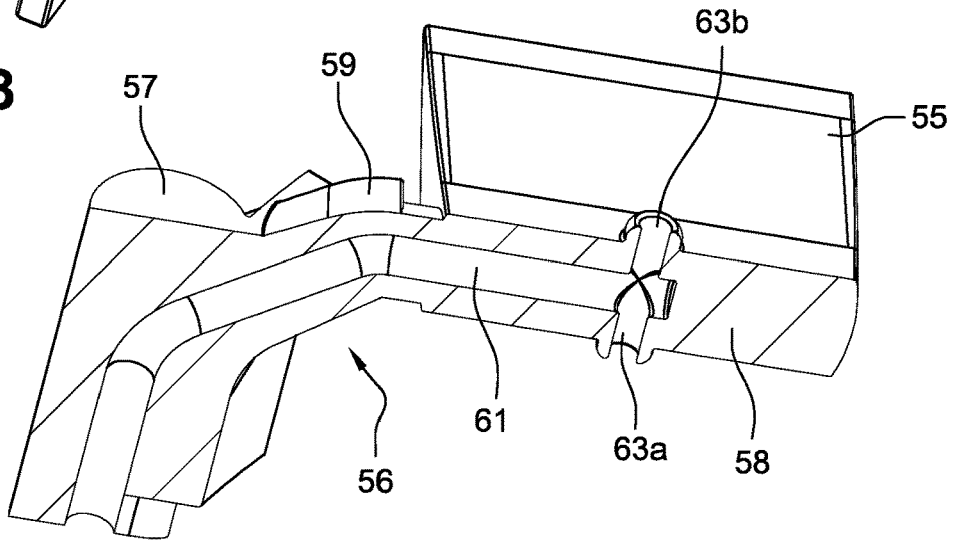
FIG. 9 is a longitudinal section view, in perspective, of the oil discharge device.

As best shown in FIGS. 1, 5, and 6 the scroll compressor 1 also includes a refrigerant suction pipe 29 for supplying the compression unit 3 with a refrigerant flow, and a refrigerant discharge pipe 30 for discharging the compressed refrigerant flow outside the scroll compressor 1.

The refrigerant suction pipe 29 extends along a longitudinal axis A, and is connected and sealed to the compression unit 3. The refrigerant suction pipe 29 is oriented towards the first and second refrigerant inlet passages P1, P2 and is configured to conduct, and more particularly to canalize, a first part of the refrigerant flow supplied by the refrigerant suction pipe 29 towards the first refrigerant inlet passage P1 and a second part of the refrigerant flow supplied by the refrigerant suction pipe 29 towards the second refrigerant inlet passage P2.

The refrigerant suction pipe 29 includes a refrigerant supplying aperture 31 having a lower section facing and emerging in the first refrigerant inlet passage P1 and an upper section facing and emerging in the second refrigerant inlet passage P2.

As shown in FIGS. 6, 10 and 11, the widths of the first and second refrigerant inlet passages P1, P2 decrease in the refrigerant flow direction, and the heights of the first and second refrigerant inlet passages P1, P2 increase in the refrigerant flow direction.

The refrigerant suction pipe 29 includes a notch 32 configured to receive a portion of the base plate 13 of the orbiting scroll arrangement 7 during at least a part of the orbital movement of the orbiting scroll arrangement 7. Advantageously, the notch 32 is provided on an end portion of the refrigerant suction pipe 29 and oriented towards the first and second refrigerant inlet passages P1, P2.

Returning to FIG. 1, the scroll compressor 1 includes a stepped drive shaft 33 adapted for driving the orbiting scroll arrangement 7 in an orbital movement relative to the lower and upper fixed scrolls 4, 5. The drive shaft 33 extends vertically across the base plate 13 of the orbiting scroll arrangement 7 and the base plates 8, 11 of the lower and upper fixed scrolls 4, 5.

The scroll compressor 1 also includes an electric driving motor 34 coupled to the drive shaft 33 and configured to turn the drive shaft 33 about a rotation axis. The drive motor 34 is mounted in an intermediate casing 35 attached to the upper fixed scroll 5. The driving motor 34, which may be a variable-speed electric motor, is located vertically above the upper fixed scroll 5, and has a rotor 36 fitted on the drive shaft 33 and a stator 37 disposed around the rotor 36.

As shown in FIG. 1, the intermediate casing 35 and the driving motor 34 define a proximal chamber 38 containing a first winding head of the stator 37, and a distal chamber 39 containing the second winding head of the stator 37. The intermediate casing 35 includes a plurality of refrigerant discharge apertures 40 emerging in the distal chamber 39. In one embodiment, the outlet aperture of each discharge passages 24 emerges in the proximal chamber 38 near to the driving motor 34, and specifically near to the first winding head of the stator 37. Advantageously, each of the discharge passages 23, 24 is inclined relative to the rotation axis of the drive shaft 33.

As shown in FIGS. 1, 10, and 11, the scroll compressor 1 also includes a first Oldham coupling 42 which is slidably mounted with respect to the lower fixed scroll 4 along a first displacement direction, and a second Oldham coupling 43 which is slidably mounted with respect to the upper fixed scroll 5 along a second displacement direction which is substantially orthogonal to the first displacement direction. The first and second displacement directions are substantially perpendicular to the rotation axis of the drive shaft 33. The first and second Oldham couplings 42, 43 are configured to prevent rotation of the orbiting scroll arrangement 7 with respect to the lower and upper fixed scrolls 4, 5. Each of the first and second Oldham couplings 42, 43 undergoes a reciprocating motion along the first and second displacement directions respectively. The first and second Oldham couplings 42, 43 are located in the inner volume 6, and more particularly in the receiving cavities 25, 26 respectively.

The first Oldham coupling 42 includes an annular body 44, a pair of diametrically opposed engaging grooves 45 provided on a first side of the annular body 44 and a pair of diametrically opposed engaging grooves 46 provided on a second side of the annular body 44. The engaging grooves 45 of the first Oldham coupling 42 are slidably engaged in a pair of complementary engaging projections 47 provided on the base plate 8 of the lower fixed scroll 4. The complementary engaging projections 47 are offset and extending parallel to the first displacement direction. The engaging grooves 46 of the first Oldham coupling 42 are slidably engaged in a pair of complementary engaging projections 48 provided on the base plate 13 of the orbiting scroll arrangement 7, the complementary engaging projections 48 being offset and extending parallel to the second displacement direction.

The second Oldham coupling 43 includes an annular body 49, a pair of engaging grooves 51 provided on a first side of the annular body 49, and a pair of engaging grooves 52 provided on a second side of the annular body 49. The engaging grooves 51 of the second Oldham coupling 43 are slidably engaged in a pair of complementary engaging projections 53 provided on the upper fixed scroll 5. The complementary engaging projections 53 are offset and extending parallel to the second displacement direction. The engaging grooves 52 of the second Oldham coupling 43 are slidably engaged in pair of complementary engaging projections 54 provided on the base plate 13 of the orbiting scroll arrangement 7. The complementary engaging projections 54 are offset and extending parallel to the first displacement direction.

Figure 4:
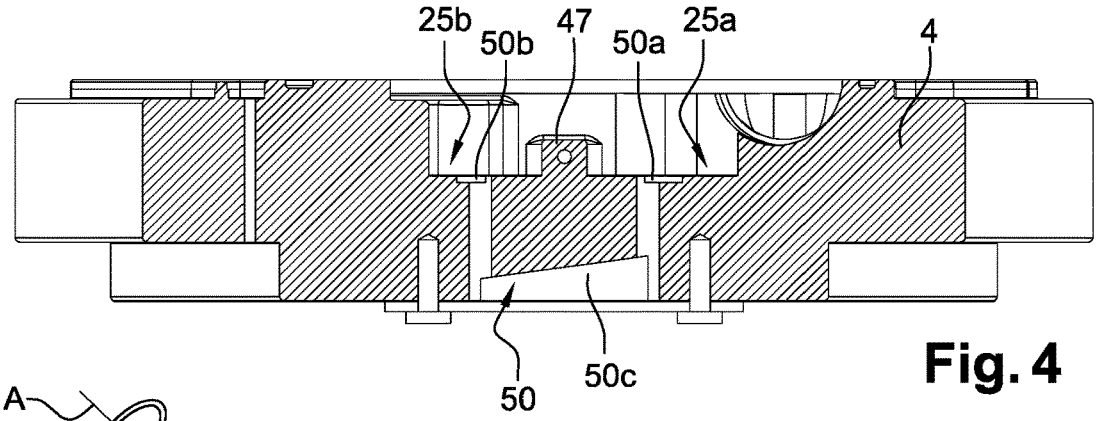
FIG. 4 is a longitudinal section view of the lower fixed scroll of FIG. 2.

As shown in FIG. 4, the complementary engaging projections 47 divide the bottom portion of the receiving cavity 25 into two bottom parts 25*a*, 25*b*. The base plate 8 of the lower non-orbiting scroll 4 further includes a communication passage 50 fluidly connecting the two separated bottom parts 25*a*, 25*b* of the receiving cavity 25. This communication passage is provided so that the oil contained in the receiving cavity 25, and specifically in the two bottom parts of the receiving cavity 25, can be completely collected by the oil collecting portion 27. The communication passage 50 includes two end apertures 50*a*, 50*b* emerging in the bottom parts 25*a*, 25*b* of the receiving cavity 25 respectively. The communication passage 50 further includes a connecting portion 50*c* in fluid communication with the end apertures 50*a*, 50*b* and configured to favor a flow of gaseous refrigerant towards the end aperture 50*a* when gaseous refrigerant is contained in the oil flowing through the communication passage 50.

As illustrated in FIGS. 3, 7, 8, and 9, the scroll compressor 1 further includes a refrigerant deflector 55 located inside the refrigerant suction pipe 29. The refrigerant deflector 55 includes a first deflecting surface 55*a* configured to deflect the first part of the refrigerant flow towards the first refrigerant inlet passage P1 and a second deflecting surface 55*b* configured to deflect the second part of the refrigerant flow towards the second refrigerant inlet passage P2. The refrigerant deflector 55 may, in one example, have a triangular cross section, and the first and second deflecting surfaces 55*a*, 55*b* may, in one example, be substantially flat.

The scroll compressor 1 also includes an oil discharge device 56 having a mounting part 57 mounted on the base plate 8 of the lower fixed scroll 4. The oil discharge device 56 further includes a discharge part 58 located in the refrigerant suction pipe 29, and a connecting part 59 connecting the mounting part 57 and the discharge part 58. The connecting part 59 extends through the notch 32 provided on the refrigerant suction pipe 29.

The oil discharge device 56 also includes an oil discharge passage 61 extending along the mounting part 57, the connecting part 59, and the discharge part 58. The oil discharge passage 61 has an oil inlet 62 in fluid communication with the receiving cavity 25, and emerging in the oil collecting portion 27. The oil discharge passage 61 has a first and a second oil discharge outlets 63*a*, 63*b* provided on the discharge part 58. The oil discharge outlets 63*a*, 63*b* are located upstream the first and second refrigerant inlet passages P1, P2 and downstream the refrigerant deflector 55 with respect to a refrigerant flow direction. The first oil discharge outlet 63*a* is configured to supply the first part of the refrigerant flow with oil from the oil collecting portion 27, and the second oil discharge outlet 63*b* is configured to supply the second part of the refrigerant flow with oil from the oil collecting portion 27.

In one example, the refrigerant deflector 55 is integral with the oil discharge device 56. Advantageously, the refrigerant deflector 55 and the oil discharge device 56 are made in one piece, and the first and second oil discharge outlets 63*a*, 63*b* project from the first and second deflecting surfaces 55*a*, 55*b* respectively.

In operation, the pressure in the inner volume 6, and thus in the receiving cavity 25, is slightly higher than the pressure in the refrigerant suction pipe 29. Due to this pressure differential and the dynamic effect of the refrigerant flow on the discharge part 58, oil is sucked from the oil collecting portion 27 at the oil inlet 62 and through the oil discharge passage 6. The oil is then supplied, in the form of oil droplets, to the first and second parts of the refrigerant flow by the first and second oil discharge outlets 63*a*, 63*b* respectively.

The first part of the refrigerant flow, which is loaded with oil sucked from the receiving cavity 25, enters the first refrigerant inlet passage P1, and then is compressed into the compression chambers 16. The first part of the refrigerant flow subsequently escapes from the center of the lower fixed scroll 4 partially through the discharge passages 23 leading to the high pressure discharge volume, and partially through the communicating hole 28 and the discharge passages 24 leading to the proximal chamber 38. The compressed refrigerant entering the proximal chamber 38 then flows in an upward direction towards the distal chamber 39 by passing through refrigerant flow passages delimited by the stator 37 and the intermediate casing 35 and through gaps delimited between the stator 37 and the rotor 36. Finally, the compressed refrigerant travels towards the discharge pipe 30 via the refrigerant discharge apertures 40.

The second part of the refrigerant flow, which is also loaded with oil sucked from the receiving cavity 25, enters the second refrigerant inlet passage P2, and then is compressed into the compression chambers 17. The second part of the refrigerant flow subsequently escapes from the center of the upper fixed scroll 5 through the discharge passages 24 leading to the proximal chamber 38.

Therefore, in use, at least a part of the oil contained in the receiving cavity 25 is discharged outside the receiving cavity 25 and outside the inner volume 6 by means of the oil discharge device 56 and the refrigerant flow. This oil discharge reduces the friction between the oil contained in the receiving cavity 25 and the first Oldham coupling 42, which increases the compressor efficiency.

Further, the configuration of the oil discharge device 56 improves the lubrication of the compression chambers 16, 17, and therefore improves their sealing.

Notably, the disclosed scroll compressor biases the orbiting scroll into the non-orbiting, fixed scrolls. However, the oil discharge configuration of this disclosure extends to scroll compressors where there is a biased non-orbiting scroll (i.e. it can move axially) in place of the fixed scrolls. Thus for the purposes of this application, the term non-orbiting scroll covers both fixed and biased non-orbiting scroll members.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A scroll compressor including a compression unit, the compression unit including:

a first non-orbiting scroll comprising a first non-orbiting base plate and a first non-orbiting spiral wrap, the first non-orbiting base plate including a receiving cavity;

an orbiting scroll arrangement including a first orbiting spiral wrap, the first non-orbiting spiral wrap and the first orbiting spiral wrap fit together, forming a plurality of first compression chambers, a refrigerant suction pipe operable to supply the compression unit with a refrigerant flow;

a first anti-rotation device located in the receiving cavity and configured to prevent rotation of the orbiting scroll arrangement with respect to the first non-orbiting scroll; and an oil discharge device including an oil discharge passage, the oil discharge passage including an oil inlet in fluid communication with the receiving cavity and at least one oil discharge outlet located in a refrigerant flow path upstream the first compression chambers with respect to a refrigerant flow direction, the at least one oil discharge outlet being configured to supply the refrigerant flow with oil from the receiving cavity.

2. The scroll compressor according to claim 1, wherein the receiving cavity includes an oil collecting portion configured to collect at least a part of the oil contained in the receiving cavity, the oil inlet being in fluid communication with the oil collecting portion.

3. The scroll compressor according to claim 2, wherein the oil inlet emerges in the oil collecting portion.

4. The scroll compressor according to claim 2, wherein the oil collecting portion is located at the deepest point of the receiving cavity.

5. The scroll compressor according to claim 1, wherein the oil discharge device includes a mounting part mounted on the first non-orbiting base plate.

6. The scroll compressor according to claim 1, wherein the oil discharge device includes a discharge port provided with the at least one oil discharge outlet, the discharge port being located in the refrigerant suction pipe.

7. The scroll compressor according to claim 1, wherein the oil discharge device includes a connecting part extending through a notch provided on the refrigerant suction pipe.

8. The scroll compressor according to claim 1, wherein the compression unit further includes a second non-orbiting scroll including a second non-orbiting base plate and a second non-orbiting spiral wrap, the first and second non-orbiting scrolls defining an inner volume, the orbiting scroll arrangement being disposed in the inner volume and further including a second orbiting spiral wrap, the second non-orbiting spiral wrap and the second orbiting spiral wrap fit together, forming a plurality of second compression chambers.

9. The scroll compressor according to claim 8, further including a refrigerant deflector configured to deflect a first part of the refrigerant flow towards the first compression chambers, and a second part of the refrigerant flow towards the second compression chambers.

10. The scroll compressor according to claim 9, wherein the oil discharge passage includes at least:

a first oil discharge outlet located upstream the first compression chambers with respect to the refrigerant flow direction, and configured to supply the first part of the refrigerant flow with oil from the receiving cavity, and a second oil discharge outlet located upstream the second compression chambers with respect to the refrigerant flow direction, and configured to supply the second part of the refrigerant flow with oil from the receiving cavity.

11. The scroll compressor according to claim 10, wherein the refrigerant deflector includes a first deflecting surface configured to deflect the first part of the refrigerant flow towards the first compression chambers and a second deflecting surface configured to deflect the second part of the refrigerant flow towards the second compression chambers, the oil discharge device being configured such that the first oil discharge outlet is offset outwardly with respect to the first deflecting surface and the second oil discharge outlet is offset outwardly with respect to the second deflecting surface.

12. The scroll compressor according to claim 9, wherein the refrigerant deflector is integral with the oil discharge device.

13. The scroll compressor according to claim 12, wherein the first and second oil discharge outlets project from the first and second deflecting surfaces respectively.

14. The scroll compressor according to claim 9, wherein the refrigerant deflector is located in the refrigerant suction pipe.

15. The scroll compressor according to claim 1, wherein the first anti-rotation device includes at least a first pair of engaging elements operable to slidably engage with a pair of complementary engaging elements provided on the first non-orbiting base plate, the complementary engaging elements dividing a bottom portion of the receiving cavity into two bottom parts, the first fixed base plate further including a communication passage fluidly connecting the two bottom parts of the receiving cavity.

* * * * *